US009885141B2

(12) United States Patent
Becchio et al.

(10) Patent No.: US 9,885,141 B2
(45) Date of Patent: Feb. 6, 2018

(54) APPARATUS FOR CONTROLLING THE CLOSING OF A DOOR OF A HOUSEHOLD APPLIANCE, IN PARTICULAR FOR A WASHING MACHINE, SUCH AS A DISHWASHER

(71) Applicant: ELBI International S.p.A., Turin (IT)

(72) Inventors: Marco Becchio, Turin (IT); Paolo Da Pont, Turin (IT); Michele Farano, Turin (IT); Paolo Ravedati, Turin (IT)

(73) Assignee: ELBI INTERNATIONAL SPA, Turin (IT)

( * ) Notice: Subject to any disclaimer, the term of this patent is extended or adjusted under 35 U.S.C. 154(b) by 583 days.

(21) Appl. No.: 14/456,785

(22) Filed: Aug. 11, 2014

(65) Prior Publication Data

US 2015/0048627 A1 Feb. 19, 2015

(30) Foreign Application Priority Data

Aug. 13, 2013 (IT) ..... TO2013A0691

(51) Int. Cl.
*E05C 1/04* (2006.01)
*E05C 1/00* (2006.01)
(Continued)

(52) U.S. Cl.
CPC ..... *D06F 39/14* (2013.01); *A47L 15/4259* (2013.01); *E05B 17/0037* (2013.01);
(Continued)

(58) Field of Classification Search
CPC ..... Y10T 292/1001; Y10T 292/1028; Y10S 292/04; Y10S 292/69
(Continued)

(56) References Cited

U.S. PATENT DOCUMENTS 1,198,509 A * 9/1916 Anderson ..... E05B 15/101 292/179
1,526,066 A * 2/1925 Hornostaj ..... E05B 65/00 292/150
(Continued)

FOREIGN PATENT DOCUMENTS

DE 19514154 A1 * 11/1995 ..... A47B 88/0477
DE 19808848 A1 * 10/1998 ..... D06F 37/42
(Continued)

OTHER PUBLICATIONS

Italian Search Report (IT TO20130691) date of completion of research Apr. 1, 2014 (9 pages).

*Primary Examiner* — Carlos Lugo
(74) *Attorney, Agent, or Firm* — Merchant & Gould P.C.

(57) ABSTRACT

An apparatus (10) includes an engagement element (11), fitted on a household appliance casing for being releasably held by a retaining element (16) fitted on the door (D). The engagement element (11) includes a support body (12); and a striker (14), releasably coupled to the retaining element (16) and is mobile between a retracted position and an extracted position. When the striker (14) is coupled to the retaining element (16) and assumes the retracted position and the extracted position, respectively, the door (D) is in a complete closing condition and in a pre-opening condition, respectively. A stop mechanism (18) moves from a release condition, to liberate said striker (14), to a locking condition, to hold said striker (14), in said retracted position; a driver controls movement of the stop mechanism (18). The stop mechanism (18) has a manually controlled safety element (18*a*) and is moveable to constrain the stop mechanism.

8 Claims, 7 Drawing Sheets

(51) Int. Cl.

| | |
|---|---|
| ***D06F 39/14*** | (2006.01) |
| ***A47L 15/42*** | (2006.01) |
| ***E05B 47/00*** | (2006.01) |
| ***E05B 17/00*** | (2006.01) |
| *A47L 15/00* | (2006.01) |
| *F24C 15/02* | (2006.01) |

(52) U.S. Cl.
CPC ..... *E05B 47/0009* (2013.01); *A47L 15/0034* (2013.01); *A47L 15/0049* (2013.01); *A47L 2401/26* (2013.01); *A47L 2501/26* (2013.01); *F24C 15/022* (2013.01); *Y10S 292/04* (2013.01); *Y10S 292/69* (2013.01); *Y10T 292/1001* (2015.04); *Y10T 292/1021* (2015.04); *Y10T 292/1028* (2015.04)

(58) Field of Classification Search
USPC ..... 292/150; 126/197
See application file for complete search history.

(56) References Cited

U.S. PATENT DOCUMENTS 1,816,134 A * 7/1931 Wood ..... E05B 63/20 292/164
3,521,618 A * 7/1970 Hagenbuch ..... F24C 15/022 126/197
3,617,957 A * 11/1971 Brighenti ..... D06F 37/42 200/61.64
3,859,979 A * 1/1975 Gilliom ..... F24C 14/02 126/19 R
3,875,372 A * 4/1975 Gilliom ..... F24C 15/022 126/197
4,032,180 A * 6/1977 Pohl ..... D06F 37/42 200/61.64
4,179,143 A * 12/1979 Shy ..... E05C 1/04 292/150
5,004,276 A * 4/1991 Hanley ..... E05C 19/022 292/126
5,012,794 A * 5/1991 Faurel ..... E05C 5/00 126/191
5,072,974 A * 12/1991 Henne ..... E05C 19/022 292/126
6,082,787 A 7/2000 Chioffi et al.
6,155,616 A * 12/2000 Akright ..... E05B 5/00 292/198
7,044,509 B2 * 5/2006 Radel ..... E05B 63/128 292/106
7,347,460 B2 * 3/2008 Ala ..... A47L 15/4259 292/216
7,383,706 B1 * 6/2008 Mahanavanont ..... E05B 65/52 292/150
7,475,921 B2 * 1/2009 Knoll ..... F24C 15/022 126/197
8,376,418 B2 * 2/2013 Osvatic ..... D06F 37/42 292/198
8,944,535 B2 * 2/2015 Becchio ..... A47L 15/4259 312/319.8
2005/0067840 A1 * 3/2005 Koveal ..... E05B 47/0012 292/95
2005/0194795 A1 * 9/2005 Hapke ..... A47L 15/4259 292/216
2008/0185849 A1 8/2008 Hartmann et al.
2014/0132135 A1 5/2014 Becchi et al.

FOREIGN PATENT DOCUMENTS

EP 2 689 705 A1 1/2014
GB 2181177 A * 4/1987 ..... D06F 37/42
JP 2006026405 A * 2/2006 ..... A47L 15/4259
WO WO 8805476 A1 * 7/1988 ..... D06F 37/42
WO 2009/146874 A1 12/2009
WO 2011/141542 A1 11/2011
WO 2013/121318 A1 8/2013

* cited by examiner

APPARATUS FOR CONTROLLING THE CLOSING OF A DOOR OF A HOUSEHOLD APPLIANCE, IN PARTICULAR FOR A WASHING MACHINE, SUCH AS A DISHWASHER

This application claims benefit of Serial No. TO2013A000691, filed 13 Aug. 2013 in Italy and which application is incorporated herein by reference. To the extent appropriate, a claim of priority is made to the above disclosed application.

TECHNICAL FIELD

The present invention relates to an apparatus for controlling the closing of a door of a household appliance, in particular for a washing machine, such as a dishwasher.

BACKGROUND

In the field of household appliances, solutions have to be found, in order to allow an inner chamber obtained in a casing of said appliances, typically a washing chamber of a washing machine, such as a dishwasher, to be closed. To this regard, a door is used, which is mobile relative to the casing so as to open and close an access opening, through which the inner chamber is able to communicate with the outside of the household appliance.

Generally, these apparatus comprise an engagement element, which is intended to be fitted on one between said casing and said door, and a retaining element, which is intended to be fitted on the other one between the door and the casing. The retaining element is suited to hold the engagement element in a releasable manner, so as to constrain the door to the casing, when the household appliance is being used.

Typically, the coupling between the engagement element and the retaining element takes place by means of the action of a user, who brings them closer by manually pushing the door against the casing, so as to obtain a complete closing. The uncoupling between the engagement element and the retaining element takes place by means of the action of the user, who acts upon suitable control interfaces (for example, provided on the front wall of the door or on the front or upper face of the casing), which activate inner mechanisms of the retaining element, which release the engagement element from the retaining element.

In this field, some apparatuses have turn out to be technically advantageous, namely those apparatuses that are designed to permit a so-called "pre-opening" of the door, in particular of washing machine, especially of dishwashers. In detail, the door is brought to an ajar state, in which it is only slightly angularly spaced apart from the casing of the household appliance, thus creating, together with the latter, a slit that is able to establish a fluid communication between the washing chamber and the outside. This solution is particularly advantageous in washing machines, for example dishwashers, since it allows the steam generated during the washing cycle to be let out, thus contributing to the at least partial drying of the articles contained in the washing chamber.

To obtain the above-mentioned pre-opening of the door, some variants of these apparatuses provide a striker, which is mounted so as to be mobile relative to a support body between a retracted position and an extracted position. When the striker is coupled to the retaining element and assumes the retracted position, the door is in a complete closing condition, in which it closes the access opening of the casing in a fluid-tight manner. On the other hand, when the striker is coupled to the retaining element and assumes the extracted position, the door is in a pre-opening condition, in which it is spaced apart from the access opening of the casing. The liberation of the striker, so that it can move from the extracted position to the retracted position, is further subordinate to a stop mechanism, which tends to move from a release position to a locking position and, in doing so, is electrically controlled by driving means, such as a motor or an actuator, which are suited to control the movement of the stop mechanism from the locking position to a release position. In the release condition the stop mechanism is adapted to free the striker, thus allowing it to move from the retracted position to the extracted position, when the striker is coupled to the retaining element. On the other hand, in the locking position condition the stop mechanism is adapted to hold the striker, when the latter is in the retracted position.

Though, these apparatus suffer from some drawbacks.

One drawback lies in the fact that, in these systems, when the washing machine is deactivated, the stop mechanism normally tends to move to the locking condition and to remain there. This situation can be potentially dangerous in case of an incorrect or accidental use of the machine on which the apparatus is installed, in particular by a baby. Consider, for example, what could happen if a baby were to enter the inner chamber of the washing machine through the access opening and close the door behind his/her back. In this case, the striker would be pushed backwards in the retracted position and the mechanism—which is in the locking position—would hold the striker in this position, thus leaving the door in a complete closed condition, with the risk for the baby of being trapped in the washing chamber.

SUMMARY

The object of the present invention is to provide and apparatus for the closing of a door of a household appliance, in particular a washing machine, such as a dishwasher, wherein the apparatus has an improved safety, even in case of an incorrect or accidental use, in particular by babies.

BRIEF DESCRIPTION OF THE DRAWINGS

Further features and advantages of the present invention will be best understood upon perusal of the following detailed description, which is provided by way of example and is not limiting, with reference to the accompanying drawings, which specifically show what follows.

DETAILED DESCRIPTION

Figure 1:
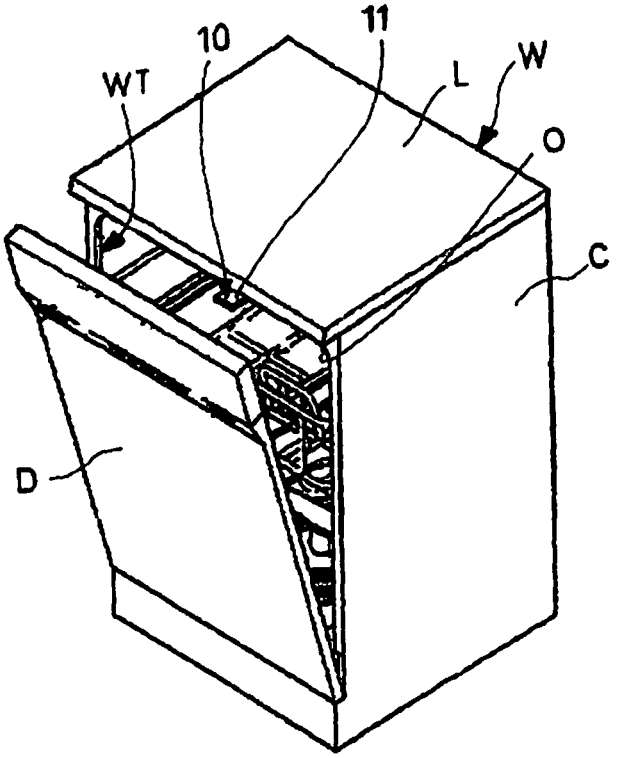
FIG. 1 is a perspective view of a dishwasher comprising an apparatus for controlling the closing of a door of a household appliance according to a first explanatory embodiment of the present invention.

With reference, in particular, to FIG. 1, W indicates, as a whole, an example of a washing machine, on which an explanatory embodiment of an apparatus 10 according to the present invention is intended to be installed. The washing machine is a dishwasher, though, as confirmed by the following description, apparatus 10 can also be applied to different washing machines (for example a laundry washing machine) or to other household appliances.

With reference, in particular, to FIG. 1, dishwasher W has a casing C, in which a washing tank or chamber WT is defined, which is suited to receive the dishes to be washed. Washing tank WT has an access opening O, through which washing tank WT communicates with the outside and which, therefore, is able to house the dishes. Furthermore, dishwasher W has a door D, which is intended to open and close access opening O.

Access opening O is arranged on a front face of casing C and, preferably, the door is pivotable relative to casing C, for example it is hinged around a horizontal axis that is arranged in the lower part of the latter. In the embodiment shown, access opening O is peripherally provided with a sealing gasket (without reference number), so as to allow washing tank WT to be closed in a fluid-tight manner, when door D is in a completely closed condition.

In the embodiment shown, casing C has a lid L, which is advantageously arranged on the top of said casing C.

Figure 2:
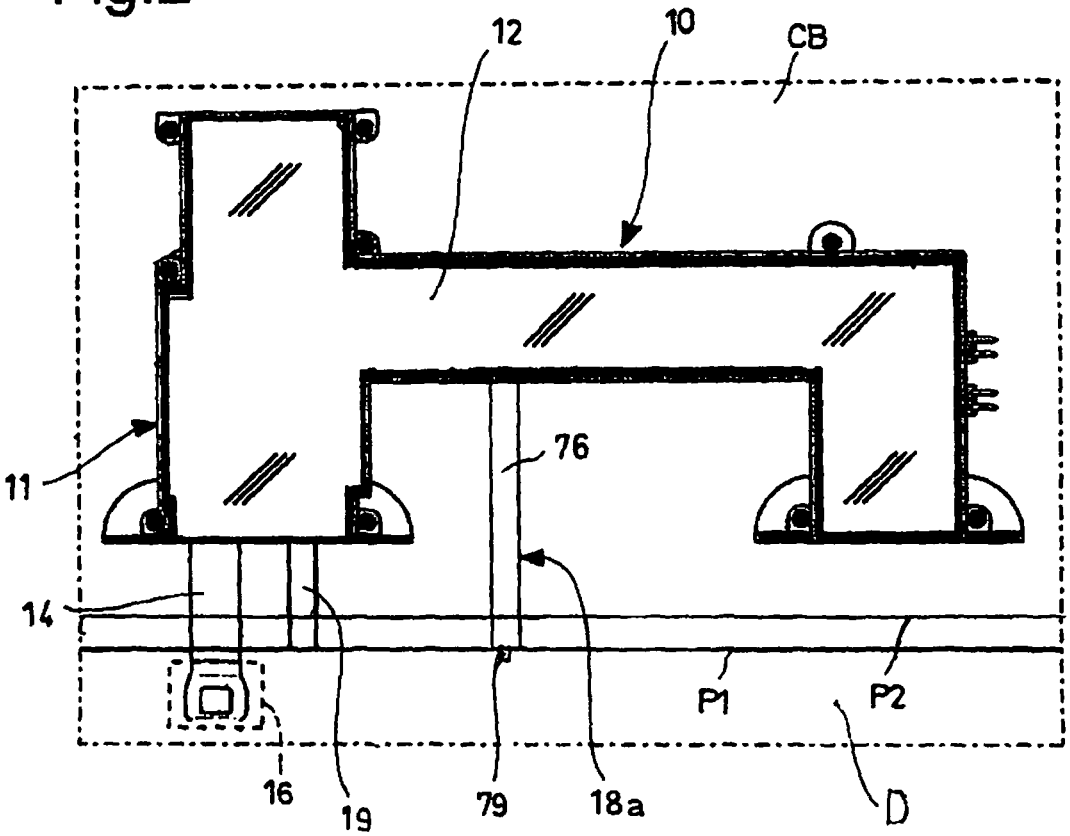
FIG. 2 is a partial schematic view, in particular a plan view from the top, of the dishwasher of FIG. 1, but without the lid and with the door in a complete closed position.
Figure 3:
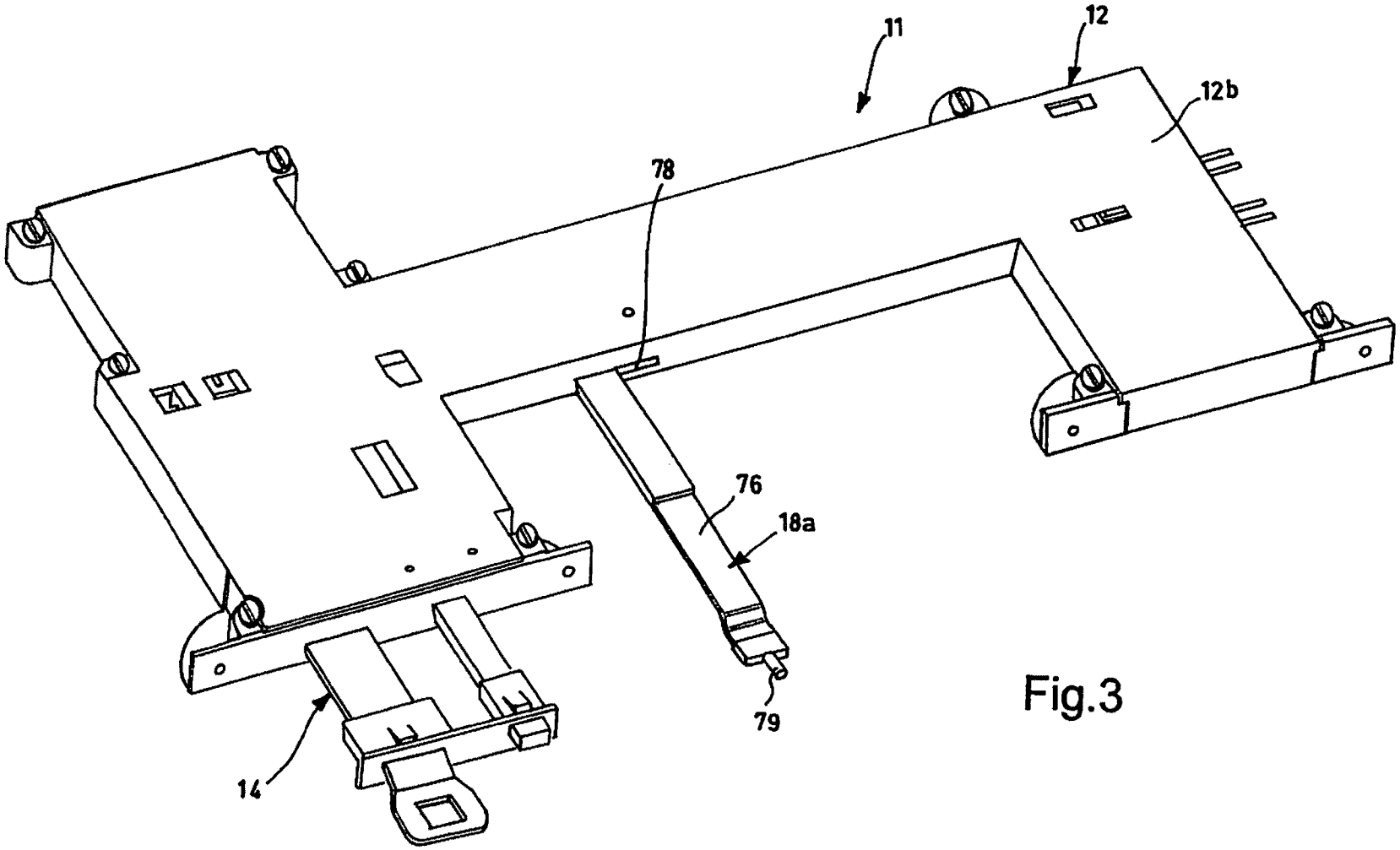
FIG. 3 is a partial perspective view of the apparatus shown in the previous figures, with some inner components visible.

In FIG. 2, washing machine W is shown in a partial view and without lid L, which is typically arranged on the top of casing C. Machine W preferably has a cross bar CB, which is arranged above a wall of washing tank WT.

Furthermore, FIG. 2 shows a pair of partitions or transverse walls P1, P2, which are arranged in the upper part of casing C and are provided so that lid L can be arranged above them. The function of these walls P1 and P2 will be described more in detail in the description below.

Apparatus 10 is suited to allow door D of dishwasher W to be closed and comprises an engagement element 11, which is suited to be fitted in correspondence to casing C, for example on cross bar CB arranged between casing C and lid L. Engagement element 11 is adapted to be held in a releasable manner by a retaining element 16, which is suited to be fitted on door D, for example on its rear face facing access opening O.

Retaining element 16 is suited to hold engagement element 11 in a releasable manner, so as to constrain door D to casing C, when washing machine W is being used. In the first embodiment shown, engagement element 11 is fitted on casing C and retaining element 16 is fitted on door D.

Engagement element 11 comprises a support body 12, which, in the embodiment shown, is fitted to casing C, and a striker 14, which is associated with support body 12 and is suited to be coupled in a releasable manner to retaining element 16, which is fitted on door D, so as to constrain door D to casing C, when dishwasher W is being used. In the embodiment shown, support body 12 is manufactured as an internally hollow case, for example comprising a pair of half-shells or cups 12*a*, 12*b*, which are coupled to one another, in particular in a snap manner, in correspondence to their periphery.

In the embodiment shown, half-shells 12*a*, 12*b* of support body 12 are manufactured with a plastic material, for example by means of injection molding. Preferably, support body 12 is screwed to casing C of household appliance W, for example in correspondence to cross bar CB.

As explained in the description below, striker 14 is mounted so as to move relative to support body 12 between a retracted position (FIGS. 2, 3, 6 and 7) and an extracted position. Advantageously, striker 14 is mobile in such a way that it is guided by support body 12, in particular by inner walls thereof. Preferably, striker 14 can slide relative to support body 12. In particular, striker 14 is manufactured with a plastic material, for example by means of injection molding.

In both the embodiments shown, in the retracted position, striker 14 partially projects from support body 12 with a segment of its, whereas, in the extracted position, striker 14 further projects with an additional segment. Preferably, striker 14 projects through a slit (without reference number), which is obtained on the front face of wall P1 of casing C of dishwasher W, on which engagement element 11, as a whole, is mounted.

In particular, when striker 14 is coupled to retaining element 16 and moves to the extracted position, retaining element 16 is moved away relative to support body 12, which consequently causes door D to be moved away, remaining at the same time constrained to casing C, though without being closed in a fluid-tight manner in correspondence to access opening O.

Restraining element 16 is substantially of a known type and has, for example, a containing body, which is provided with a slit and houses a coupling mechanism, which can be accessed by striker 14 through said slid, so as to allow the striker 14 itself to be coupled in a releasable manner to said coupling mechanism. Generally, said coupling mechanism is pivotable between an operating position and a rest position and comprises a rotary member, whose movement is opposed by an elastic member and which is suited be engaged in a releasable manner by striker 14. In the operating position, the rotary member of the coupling mechanism holds striker 14 when door D is closed. On the other hand, in the rest position, the rotary member of the coupling mechanism liberates striker 14 when the user operates a suitable release mechanism (not shown), for example including a push-button, a lever or a knob, which is arranged on door D.

Examples of a retaining element 16 of the type described above are widely known in the technical field and are described in detail in many prior art documents. In order to provide complete information, the Italian patent applications no. TO97A1120, TO2000A000383 and TO2001A01003 are mentioned, whose content is to be considered as included herein by means of reference and by mere way of example. Therefore, for sake of brevity, retaining element 16 will not be further described in the description below.

When striker 14 is coupled to retaining element 16 and is arranged in its retracted position, engagement element 11 is in the arrangement shown in FIG. 2, in which door D is in a complete closing condition, thus closing access opening O of washing chamber WT in a fluid-tight manner. On the other hand, when striker 14 is coupled to retaining element 16, but is arranged in its extracted position, door D assumes a pre-opening condition, thus being slightly spaced apart from access opening O of casing C, so as to establish a fluid communication between washing chamber WT and the outside of casing C. In particular, in the pre-opening condition, the steam contained in washing tank WT (which, for example, is generated during a washing cycle of dishwasher W) is allowed to flow out of dishwasher W, so as to allow the dishes contained therein to be at least partially dried.

In other words, when striker 14 is coupled to retaining element 16 and moves to the extracted position, it allows retaining element 16 to be moved away from support body 12, which consequently causes door D to be moved away from casing C. Though, due to the coupling between striker 14 and retaining element 16, door D remains in any case constrained to casing C, though without closing access opening O in a fluid-tight manner.

Figure 6:
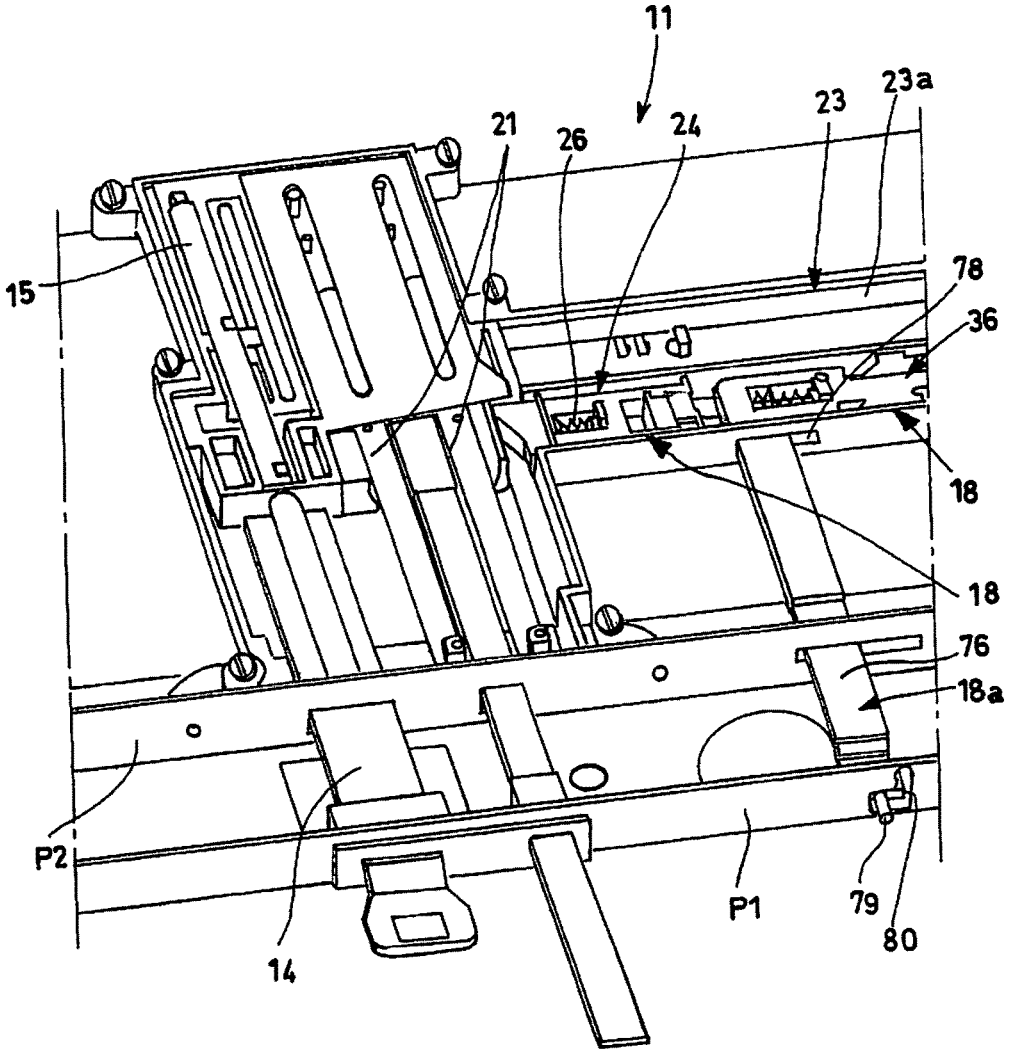
FIGS. 6 and 7 are perspective views of the apparatus shown in the previous figures, which, here, is shown in two different operating conditions.
Figure 7:
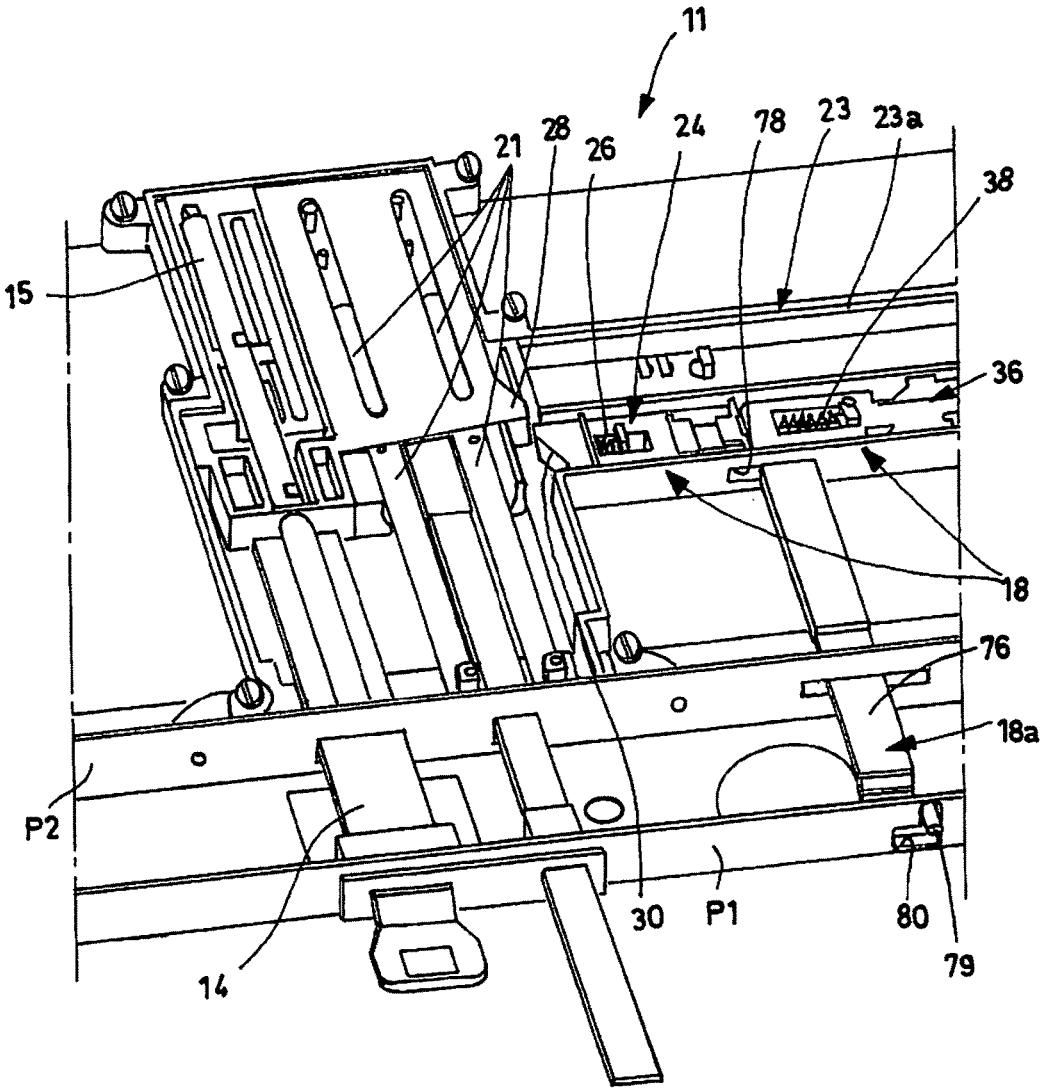
Figure 8:
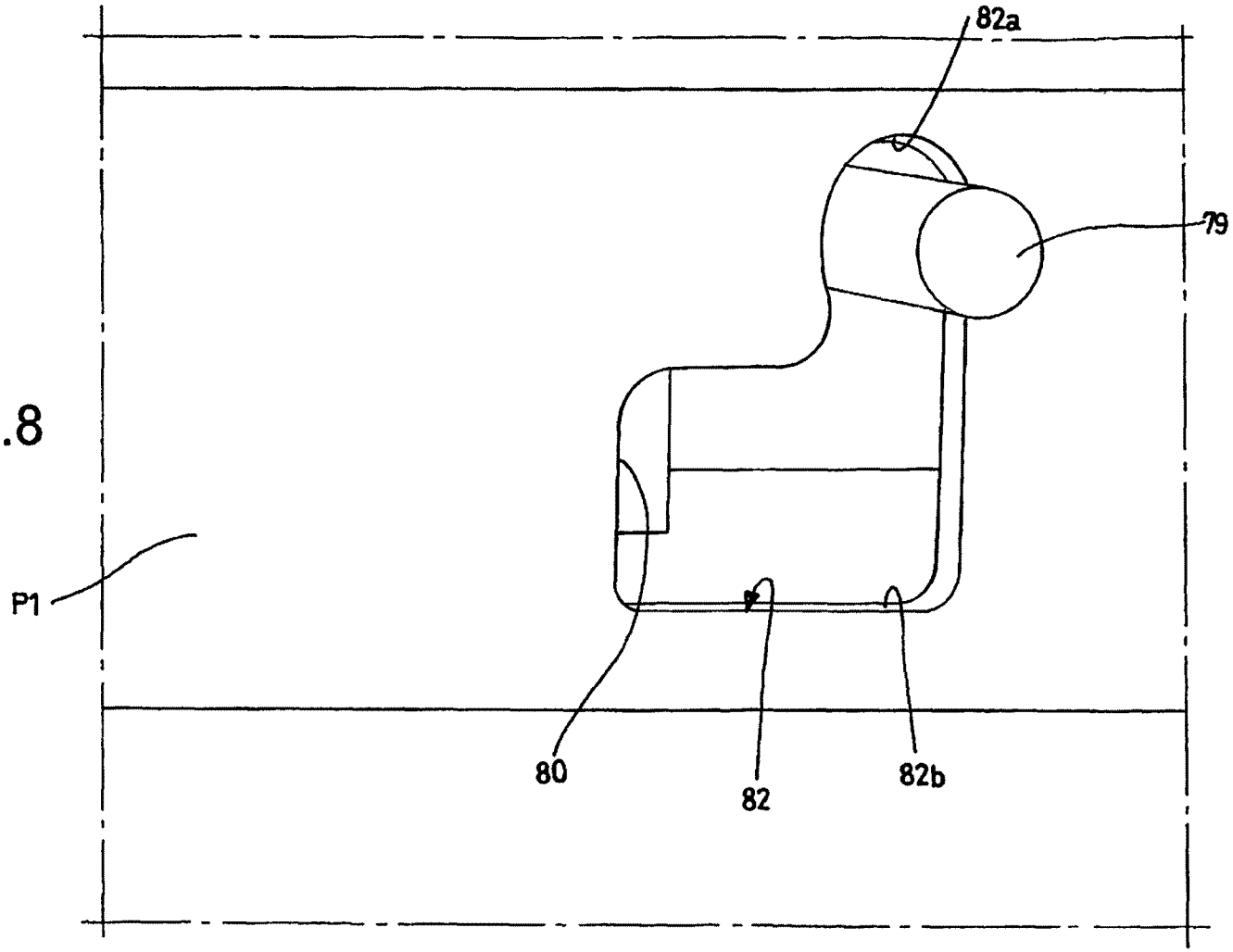
FIG. 8 is a front perspective view of manufacturing details concerning the stop mechanism of the apparatus shown in the previous figures.

With reference, in particular, to FIGS. 6 and 7, engagement element 11 comprises, furthermore, a stop mechanism, which is indicated, as a whole, with number 18. In both the embodiments shown, stop mechanism 18 is fitted on support body 12; in particular, it is contained in the cavity defined by support body 12 itself.

Stop mechanism 18 tends to move from a release position (not shown), in which it is adapted to liberate striker 14, thus allowing the latter to move from the retracted position to the extracted position, when said striker 14 is coupled to retaining element 16, to a locking position (FIGS. 6, 7), in which it is adapted to hold striker 14, when striker 14 is in the retracted position.

Furthermore, engagement element 11 comprises driving means, in the embodiment shown an electrically-operated actuator 20, which is suited to control the movement of stop mechanism 18 from the locking condition to the release condition. By way of example, this movement is performed when actuator 20 is excited by the passage of an electric current. In other embodiments, an electric motor can be used instead of actuator 20.

In the embodiment shown, actuator 20 is connected to an outer control unit associated with household appliance W and is able to supply power to actuator 20 in predetermined operating conditions. Preferably, actuator 20 is mounted on support body 12, for example it is housed in the cavity defined therein.

According to the present invention, stop mechanism 18 comprises a safety element 18*a*, which can be manually controlled by a user and can be moved between a liberation arrangement and an inhibition arrangement. In the liberation arrangement (shown in FIG. 6), safety element 18*a* allows stop mechanism 18 to move between the locking condition and the release condition, in particular in such a way that it is controlled by the driving means, for example by actuator 20. On the other hand, in the inhibition arrangement, safety element 18*a* forcedly constrains stop mechanism 18 in the release condition, thus preventing it from assuming the locking condition.

In this way, the safety of apparatus 10 is improved, especially in case of an incorrect use of dishwasher W, in particular by babies. As a matter of fact, if the safety element is manually moved by a user to the inhibition arrangement, should a baby enter the inner chamber of washing machine W through access opening O and close door D behind his/her back, striker 14 would be pushed backwards to the retracted position, but mechanism 18 would not be able to reach the locking condition. Therefore, even if striker 14 were to be coupled to engagement element 11, stop mechanism 18 would not be able to hold striker 14 in the retracted position and, hence, door D would move back outwards in the pre-opening position, thus preventing the baby from getting trapped in the washing tank with the risk of suffocating.

Further advantageous features and preferred details of safety element 18*a* will be described more in particular in the description below.

Furthermore, engagement element 11 preferably comprises return means 15, which are suited to optionally cause striker 14 to go back to the retracted position when the striker is uncoupled from retaining element 16. In particular, return means 15 are fitted on support body 12. In this way, striker 14 is prevented from excessively projecting—in a way that can possibly be dangerous for the safety of the users—from casing C of dishwasher W, when a user uncouples striker 14 from retaining element 16, by acting upon the proper release mechanisms provided on dishwasher W, and moves door D from the pre-opening condition to the complete closing condition.

Preferably, the return means comprise elastic return means, for example including a return spring 15. In particular, the elastic return means are adapted to operate in a pulling manner.

Preferably, apparatus 10 comprises, furthermore, a pushing member 19, which is able to deliver a thrust in the moving direction of striker 14 from the retracted position to the extracted position, which is intended to be exerted on door D, thus helping it move to the pre-opening condition, when striker 14 is coupled to retaining element 16 and stop mechanism 18 is in the release condition. In this way, the movement of door D from the complete closing condition to the pre-opening condition becomes easier and more reliable.

In simpler alternative variants, pushing member 19 can be omitted from the apparatus, since the own weight of door D, combined with the elastic force exerted by the sealing gasket fitted around opening O, can be able to allow door D to open. In this variant, elastic return means 15 can be left out, as well, so as to facilitate the pre-opening of door D, provided that the projection of striker 14 with the door completely open is substantially negligible and does not constitute a problem or a danger for the users.

In the embodiment shown, pushing member 19, for example with a substantially oblong shape, is mounted so as to be mobile relative to support body 12 and exert the aforesaid thrust, thus moving from a retracted condition to an extracted condition. In this way, manufacturers can obtain a compact configuration of apparatus 10 by using a pushing member 19 that is built-in in the structure of engagement element 11.

In particular, in the retracted condition, pushing member 19 slightly projects from support body 12 with a segment (or, if necessary, it can also be completely contained therein), whereas, in the extracted condition, pushing member 19 further projects with an additional segment.

Advantageously, pushing member 19 is housed inside support body 12 so as to slide relative to the latter, for example so as to be guided by inner walls of said support body 12.

In the embodiment shown, engagement element 11 comprises, furthermore, elastic stressing means 21, which act upon pushing means 19 and tend to move it to the extracted condition.

In particular, elastic stressing means 21 act upon pushing member 19 in such a way that they tend to move it to the extracted condition. In the embodiment shown, elastic stressing means 21 are mounted between support body 12 and pushing member 19 and, for example, are adapted to operate in a pulling manner, thus attracting pushing member 19 towards the outside of the support body. Advantageously, elastic stressing means 21 comprise at least one pulling spring 21 and, in particular, a pair of pulling springs 21 are provided.

In the embodiment shown, striker 14 and pushing member 19 are mobile in directions that are parallel to one another.

Preferably, striker 14 and pushing member 19 are fitted to one another in a mutually guided manner, in particular by means of sliding.

More preferably, striker 14 and pushing member 19 are mutually integral during their movement from the respective retracted position or condition to the relative extracted position or condition, when striker 14 is coupled to said retaining element 16 and stop mechanism 18 liberates striker 14, thus moving from the locking condition to the release condition. This solution is particularly useful to avoid that—during the movement from the retracted position to the extracted position of striker 14—pushing member 19 and door D (whose position depends on the position of striker 14 due to the coupling between engagement element 11 and retaining element 16) end up in mutual position that are not ideal to perform a pushing action during the preopening. In the embodiment shown, pushing member 19 is caused to be integral with striker 14 in a sliding manner by causing striker 14 to lie on pushing member 19.

Conveniently, striker 14 is able to slide relative to pushing member 19 along at least a segment of the movement from the extracted position to the retracted position and, in doing so, is controlled by said return means 15 when striker 14 and retaining element 16 are uncoupled. In this embodiment, striker 14 can slide from the extracted position to the retracted position regardless of the movement of pushing member 19.

Figure 4:
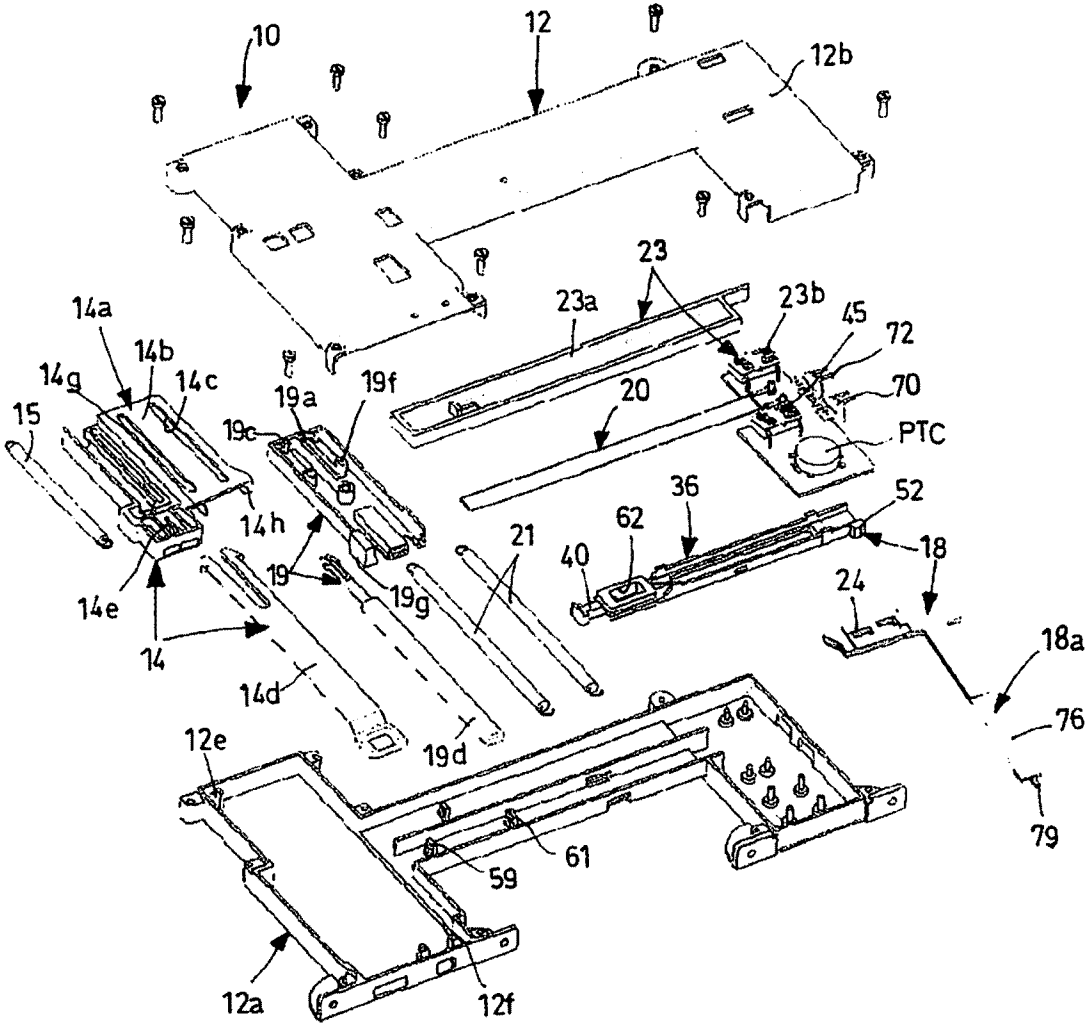
FIG. 4 is an exploded perspective view of the apparatus shown in the previous figures.
Figure 5:
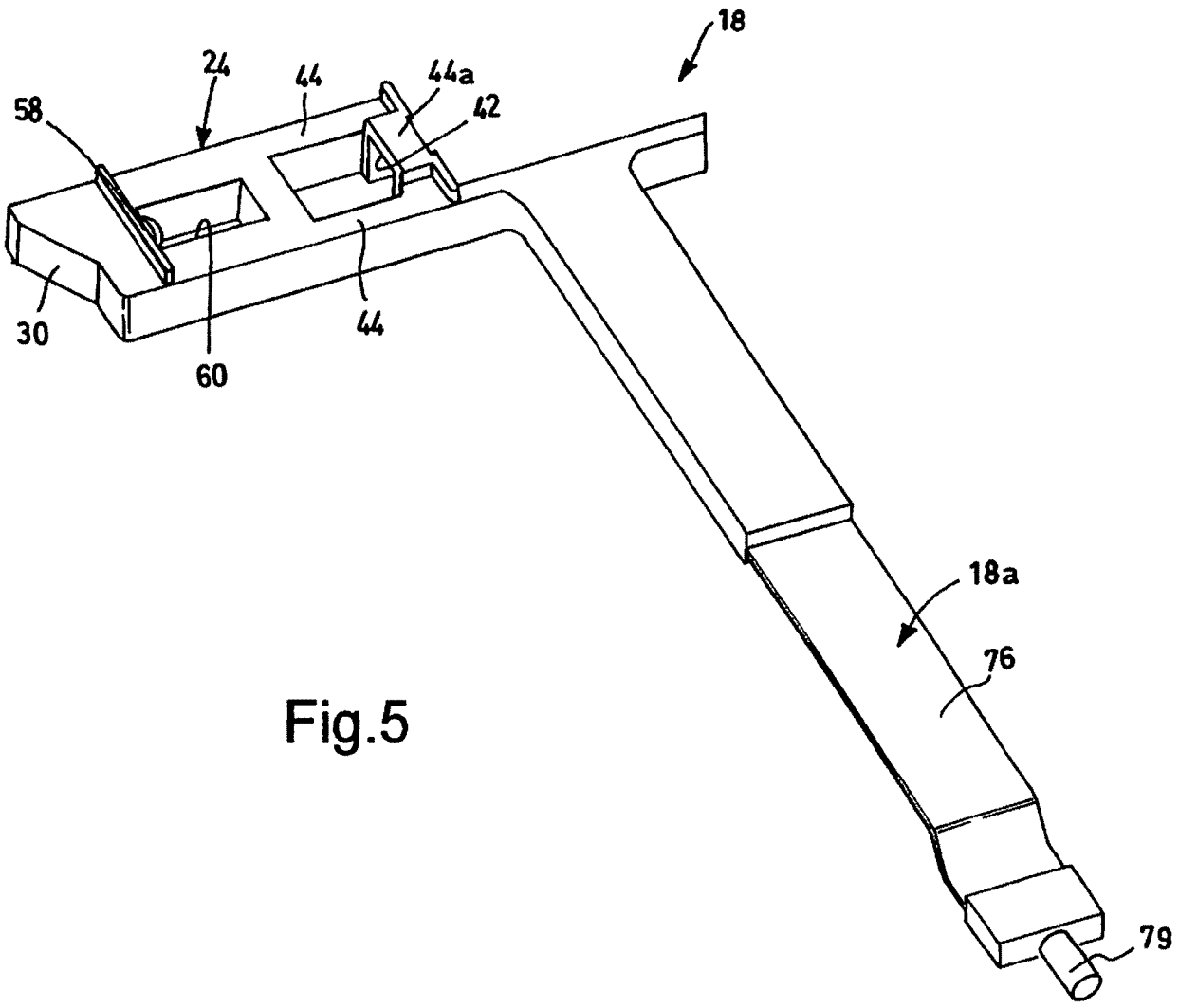
FIG. 5 is a perspective view of a component of a stop mechanism of the apparatus shown in the previous figures.

In the embodiment shown, striker 14 and pushing member 19 have mutual proximal sliders 14*a* and 19*a*, which cooperate with one another so as to perform the guided sliding described above. In this first embodiment shown, proximal slider 14*a* has a transverse extension 14*b* where proximal slider 19*a* is mounted so as to slide, advantageously in a "drawer-like" manner, in an axial direction between the retracted condition and the extracted condition of pushing member 19. With reference, in particular, to FIG. 4*a*, transverse extension 14*b* has suitable slots 14*c*, which are axially oriented and within which complementary projections, for example pins 19*c*, carried by proximal slider 19*a* can slide.

In the embodiment shown, striker 14 and pushing member 19 have mutual distal appendages 14*d* and 19*d*, which are mounted on proximal sliders 14*a* and 19*a* and are adapted to project outwards from support body 12 (through front slits or openings made on the latter), so as to cooperate with retaining element 16 and door D. In particular, each distal appendage 14*d* and 19*d* has a pair of connection stems (without reference numbers), which can be elastically spread apart and can be coupled, by means of interference, in suitable slits (without reference numbers) that are frontally obtained in proximal sliders 14*a* and 19*a*.

In the embodiment shown, unlike the distal appendages 14*d* and 19*d*, proximal portions 14*a* and 14*b* are advantageously always contained inside the case defined by support body 12, without projecting outwards from the latter during the movements of striker 14 and of pushing member 19.

In this embodiment, return spring 15, advantageously operating in a pulling manner, is mounted between a pin 14*e* carried by striker 14, in particular by proximal slider 14*a*, and a respective pin 12*e* carried by support body 12.

In the embodiment shown, each stressing spring 21, advantageously operating in a pulling manner, is mounted between a respective pin 19*f* carried by proximal slider 19*a* and a respective pin 12*f* carried by support body 12.

In particular, when return spring 15 is provided, the force exerted by it upon striker 14 is advantageously smaller than the force exerted by stressing spring 21 upon pushing member 19.

In the embodiment shown, respective proximal portions 14*a* and 19*a* have respective abutments 14*g* and 19*g*, adapted to mutually lean against one another during the movement from the respective retracted position or condition to the respective extracted position or condition. In particular, abutment 14*g* is adapted to lean against abutment 19*g* so as to cause pushing member 19, in use, to be kept lying against door D, in order to exert an ideal thrust during the preopening.

By way of example, the abutment of striker 14 is defined by an upper edge 14*g*, which is brought to an axially forward position by the transverse extension 14*b*, whereas the abutment of pushing member 19 is defined by a tooth 19*g*, which projects from the upper part of the proximal portion 19*a* in an axially forward position thereof.

Clearly, during the return of striker 14 towards the retracted position, the contact between abutments 14*g* and 19*g* stops, thus causing the position of striker 14 along pushing member 19 to become independent.

Preferably, stop mechanism 18 is intended to constrain striker 14, thus preventing it from moving to the extracted position, when striker 14 is in the respective retracted position and stop mechanism 18 is in the locking condition.

In this way, stop mechanism 18 is designed to directly act upon striker 14, thus preventing door D from moving away from casing C against the action of pushing member 19.

Preferably, stop mechanism 18 is suited to act in a transverse direction relative to the direction of the movement of striker 14.

In this embodiment, stop mechanism 18 is suited to act so as to liberate or hold a transverse projection 14*h* carried by striker 14, for example by transverse extension 14*b*.

Preferably, apparatus 10 comprises detector means 23, which are suited to detect the extracted condition or position of at least one between striker 14 and pushing member 19. In this way, one can obtain an indirect indication on the state of door D during the use. In this embodiment, the detector means are intended to monitor the position of striker 14 and, therefore, are adapted to provide an indication concerning the fact that striker 14 is in the extracted position—and, hence, that door D is in the preopening condition.

Advantageously, detector means 23 comprise a mobile element 23*a*, which can be moved relative to the support body 12 and, in doing so, is controlled by at least one between striker 14 and pushing member 19, as well as a sensitive member 23*b*, which is intended to provide an indication of the position assumed by mobile element 23*a*.

For example, mobile element 23*a* can be moved from support body 12 in a guided manner, in particular in a transverse direction relative to the direction in which striker 14 or pushing member 19 is adapted to be moved. Advantageously, mobile element 23*a* is housed inside the case created by support body 12. Preferably, the mobile element is a sliding cursor 23*a*, which, on one side, cooperates with striker 14 or pushing member 19 and, on the other side, cooperates with sensitive member 23*b*.

For example, the sensitive member is a switch 23*b*, in particular a micro-switch, suited to be activated by mobile element 23*a*, for example by an appendage (without reference number), which is carried by mobile element 23*a* and is able to activate switch 23*b* according to predetermined criteria.

Preferably, mobile element 23*a* is suited to be pushed, while lying against striker 14, due to counteracting elastic means (without reference numbers). More in detail, the action of the counteracting elastic means takes place so as to bring mobile element 23*a* from a normally inactive condition, in which it does not activate sensitive member 23*a* when striker 14 is in the retracted position, to an active condition, in which it activates sensitive member 23*a* when striker 14 is in the extracted position or condition.

In this embodiment, mobile element 23*a* is associated with and pushed by striker 14, for example by transverse projection 14*h*, which tends to push it towards the normally inactive condition. When transverse projection 14*h*, during the movement of the striker towards the extracted position, moves past mobile element 23*a*, the latter is able to move to the active condition.

Preferably, actuator 20 is suited to move from a normally extended condition (FIGS. 6 and 7) to a contracted condition. In the extended condition, actuator 20 allows stop mechanism 18 to assume the locking position, whereas, in the contracted position, actuator 20 brings stop mechanism 18 to the release position.

More preferably, actuator 20 comprises a shape-memory conductor element 22, which is mechanically connected to and cooperates with stop mechanism 18. In particular, conductor element 22 is made of a shape memory alloy (SMA), which is able to assume a predetermined shape (in this case, corresponding to the one assumed in the contracted condition) subsequent to a variation of the due temperature, in the embodiment shown, due to the Joule heating caused by the passage of current through it.

In alternative embodiments, which are not shown, conductor element 22 can be replaced by different types of electric actuators; in these embodiments, the actuator can comprise an electromagnetic actuator (e.g. of the solenoid type) or an electrothermal actuator (e.g. of the wax type). The above-mentioned types of actuators are known in the technical field and, therefore, for the sake of brevity, they will not be described hereinafter.

As described more in detail below, in the embodiment shown, conductor element 22 has the shape of a wire, which is mechanically connected to—and acts upon—stop mechanism 18, so as to move the latter from the normal locking condition to the release condition.

In the embodiment shown, conductor element 22 is advantageously connected in series to a positive temperature coefficient (PTC) thermistor.

Preferably, stop mechanism 18 comprises a slider 24, which is mounted so as to move—in particular to slide—relative to support body 12 from a locking position (FIG. 6) to a release position (FIG. 7). In the locking position, slider 24 is adapted to hold striker 14 when it is arranged in the retracted position, thus preventing it from moving to the extracted position and to the extracted condition, respectively. On the other hand, in the release position, slider 24 allows striker 14 to move (from the retracted position to the extracted position) due to an electric excitation of actuator 20. Furthermore, stop mechanism 18 comprises an elastic member 26, which is prone to hold slider 24 in the locking position. In the embodiment shown, elastic member 26 is interposed between support body 12 and slider 24. Preferably, elastic member 26 is a spring, for example a compression-preloaded spring, advantageously of the helical type.

Preferably, slider 24 is positioned against a projection, which is transversely obtained in striker 14, when slider 24 is in the locking position and striker 14 is in the retracted position. In the embodiment shown, the aforesaid projection advantageously coincides with transverse projection 14*h* of striker 14.

Therefore, in the embodiment shown, stop mechanism 18 substantially has the properties of a ratchet device, in which slider 24 acts as a ratchet, which is adapted to prevent striker 14 from moving. In particular, when engagement element 11 and retaining element 16 are coupled to one another, striker 14, on the one hand, is subject to "extraction" forces, which are due to the pushing force of pushing member 19 and also to the weight of door D, if necessary with the help of the elastic compression of sealing gasket SG. On the other hand, when engagement element 11 and retaining element 16 are coupled to one another, striker 14 is subject to "retraction" forces, which are due to the action of possible return means 15 and are generally smaller then the stressing forces exerted during the opening. Hence, when stop mechanism 18 is in the locking condition, the slider 24 that constrains the striker 14 prevents the "extraction" forces from being able to activate apparatus 10 so as to move door D to the pre-opening condition.

In this embodiment and with reference, in particular, to FIG. 7, striker 14 and slider 24 preferably have complementary profiles 28 and 30, which cooperate one with the another. Profiles 28 and 30 are adapted to permit, by means of interference, the forced movement of striker 14 from the extracted position to the retracted position, if necessary performed with the contribution of return means 15 opposing the action of elastic member 26. To this regard, if return means 15 are provided, they are preferably dimensioned so as to exert a return force, for example an elastic pulling force, with an intensity that is such as to overcome the opposing elastic force of elastic member 26.

In this embodiment shown, profiles 28 and 29 are respective inclined sections of projecting noses (without reference numbers), which are supported by striker 14 and slider 24, respectively, in particular by the transverse projection. The cooperation between profiles 28 and 30 will be described in detail below, together with the overall operation of apparatus 10.

In the embodiment shown, stop mechanism 18 comprises, furthermore, a cursor 36, which can be moved by means of actuator 20 and is mounted so as to move—in particular can slide—relative to support body 12 from an inactive position (FIGS. 3, 5, 6 and 7) to an active position. In the inactive position, cursor 36 allows slider 24 to move from the release position to the locking position due to the action of elastic member 26. On the other hand, in the active position, cursor 36 drags slider 24 from the locking position to the release position against the action of elastic member 26, when actuator 20 is electrically excited. Furthermore, stop mechanism 18 comprises an elastic element 38, which is intended to hold cursor 36 in the locking position. In the embodiment shown, elastic element 38 is mounted between support body 12 and cursor 36. Preferably, the aforesaid elastic element 38 is a spring, for example a compression-preloaded spring, advantageously of the helical type.

Preferably, cursor 36 is mechanically connected to shape-memory element 22 and, therefore, is adapted to be dragged by the latter between the inactive position and the active condition. In the embodiment shown, shape-memory element 22 is configured as a conductor wire 22, which is connected to cursor 36 and, for example, is arranged in a U-shape so as to surround a part of cursor 36 with its loop.

In the embodiment shown, slider 24 and cursor 36 are coupled with a sliding clearance. Preferably, the coupling between slider 24 and the cursor substantially is of the so-called "coulisse" type. More preferably, cursor 36 has a mushroom-shaped end 40 and slider 24 has a shaped cavity 42, which houses mushroom-shaped end 40 with an axial clearance. Even more preferably, mushroom-shaped end 40 has a transversely wide head and a narrow neck transversely tapering from the head; cavity 42, in turn, has a transversely wide proximal portion, which houses the head with an axial clearance, and a transversely narrow distal portion, which starts from the proximal portion and allows the neck to axially slide through it (details without reference numbers). Advantageously, shaped cavity 42 is defined by a pair of lateral arms 44, which are arranged at the end of slider 24 and transversely converge inwards in correspondence to their free ends. Advantageously a closing crosspiece 44*a* is fitted above lateral arms 44, after the coupling with head 42—for example by means of interference; in this way, one can reduce the risk of an undesired displacement of head 42 beyond the lateral arms 44.

In the embodiment shown, elastic element 38 exerts a return elastic force upon cursor 36, which is greater than the return elastic force exerted by elastic member 26 upon slider 24. In this way, elastic element 38 is able to effectively cause cursor 36 to return to its active position, in particular by causing conductor wire 22 to return in a reliable manner and with a high intensity force. Furthermore, in this way, elastic organ 36 is able to bring slider 24 back to the locking position, without for this reason causing the action of possible return means 15 to become uncomfortable by applying an excessive resistance, return means 15 being used to forcedly cause the uncoupling of striker 14 of engagement element 11 from retaining element 16 by acting upon a proper release mechanism arranged on door D or on casing C.

In the embodiment shown, slider 24 and/or cursor 36 can be moved in a direction that is substantially transverse, and preferably orthogonal, to the movement direction of striker 14. By way of example, slider 24 and cursor 36 can be moved in the same direction.

Preferably, stop mechanism 18 is suited to interrupt the electric excitation of actuator 20 after stop mechanism 18 has assumed the release condition. More preferably, actuator 20 comprises a safety switch 45, for example a microswitch, which is controlled by stop mechanism 18 and is suited to electrically disconnect actuator 20 from the outer control unit, when stop mechanism 18 reaches the release condition. In the embodiment shown, switch 45 is electrically connected downstream of one of the supply contacts (without reference numbers) that allow actuator 20 to be connected to the outer control unit. By way of example, the supply contacts are electrically connected to the ends of conductor wire 22.

Preferably, switch 45 comprises a stationary contact (without reference number) and a mobile contact (without reference number), which cooperates with stop mechanism 18, so as to be moved away from the stationary contact when stop mechanism 18 reaches the release condition. In the embodiment shown, the mobile contact has a shaped projection, adapted to come into contact with a corresponding projection 52 supported by stop mechanism 18, for example by cursor 36, so that the mobile contact moves away, for example by bending, from the stationary contact, when stop mechanism 18 reaches the release condition, for example when cursor 36 reaches the active position. Preferably, the shaped projection of the mobile contact has a spire-shaped profile. Preferably, projection 52 has the shape of an inclined segment, which substantially matches the segment of the spire-shaped profile provided by the mobile contact.

Preferably, elastic member 26 is axially interposed between a projecting overhang 58 of slider 24 and a stationary bracket 59 projecting from support body 12, for example from the lower half-shell 12*b*. Preferably, bracket 59 is housed in correspondence to a guide opening 60, which is obtained through slider 24. In this way, elastic member 26 is able to push overhang 58, which is integral to slider 24, until an end edge of the aforesaid guide opening 60 comes into contact with stationary bracket 59, which corresponds to the locking position of slider 24. Therefore, stationary bracket 59 also acts as a limit stop for slider 24.

Preferably, cursor 36 can slide in support body 12 and, in doing so, is preferably guided by the inner walls of support body 12, for example by walls of the lower half-shell 12*b* and by the bottom walls of both half-shells 12*a* and 12*b*.

Preferably, elastic element 38 is axially interposed between a further overhang (without reference number) projecting from cursor 36 and a further stationary bracket 61 projecting from support body 12, for example from the lower half-shell 12*b* Preferably, the further bracket 61 is housed in correspondence to a further guide opening 62, which is obtained through cursor 36, for example close to the further overhang. In this way, elastic element 38 is able to push the further overhang, which is integral to cursor 36, until an end edge of the further guide opening 62 comes into contact with the further stationary bracket 61, which corresponds to the inactive position of cursor 36. Therefore, the further stationary bracket 61 also acts as a limit stop for the cursor.

In the embodiment shown, switches 23*b* and 45, together with the PTC thermistor are carried by a support or plate PCB, in which a printed circuit is obtained, which connects the switches and the thermistor. Advantageously, support PCB has two pairs of connection terminals 70 and 72, which are suited to supply electric power to the actuator means and to detector means 23, respectively, for example through the PTC thermistor and through switch 23*b*, respectively.

Below you can find a more detailed description of the structure and the function of safety element 18*a*.

In the embodiment shown, safety element 18*a* prevents slider 24 from moving to the locking position, when safety element 18*a* itself is in its inhibition arrangement (FIG. 7). In particular, safety element 18*a* holds slide 24 in the release position, when it is in its inhibition arrangement, which corresponds to the fact that stop mechanism 18 is not able to assume the locking condition.

Preferably, slider 24 carries safety element 18*a*.

In the embodiment shown, safety element 18*a* is integral to, preferably manufactured as one single piece together with, slider 24, so that, in the inhibition arrangement, by generating a mechanical constraint associated with safety element 18*a*, slider 24 is accordingly prevented from moving.

Preferably, safety element 18*a* is a lever or appendage 76, for example with an oblong shape, capable of projecting from said slider 24 in a position in which it is accessible to a user and is fit to be grabbed by the latter. In this way, the user can easily and comfortably interact with safety element 18*a* so as to manually move it between the liberation arrangement and the inhibition arrangement. In the embodiment shown, lever or appendage 27 projects from slider 24 in a substantially transverse direction relative to the movement axis of slider 24.

Preferably, lever or appendage 76 projects outwards from support body 12, in the embodiment shown through a groove 78, which is obtained on support body 12, for example on half-shell 12*b*. In particular, lever or appendage 76 is guided by groove 78 so as to also guide the movement of slider 24 between the locking position and the release position.

In the embodiment shown, lever or appendage 76 is provided with a portion, for example its distal end 79, adapted to cooperate with a shaped profile 80, in which, in the inhibition arrangement, distal end 79 is constrained to shaped profile 80, thus preventing slider 24 from moving towards the release position. In particular, in the inhibition arrangement, shaped profile 80 mechanically locks the movement of distal end 79, thus preventing slider 24 from moving from the release position, until a user manually intervenes by moving again lever or appendage 76 to the liberation arrangement. In alternative embodiments, the aforesaid portion—cooperating with shaped profile 80—can be different from distal end 79, for example it can also be an intermediate segment of the above-mentioned lever or appendage 76.

Preferably, distal end 79 of the lever or appendage is substantially shaped as a pin, which, for example, can be inserted into and removed from (in particular, laterally) a part of shaped profile 80, so as to create and release, respectively, the forced mechanical constraint of stop mechanism 18.

In the embodiment shown, shaped profile 80 is provided by a slot 82, which is obtained in the washing machine and in which distal end 79 is adapted to be engaged in the inhibition arrangement In particular, slot 82 has a narrow segment 82*a*, in which distal end 79 can be inserted in an engagement condition, by slightly bending (in this embodiment, upwards) lever or appendage 76, so that narrow portion 82*a* can steadily receive, for example by means of mechanical interference, distal end 79. In other words, lever or appendage 76 is moved until slider 24 reaches the release position and, then, it is slightly bent towards narrow portion 82*a* of slot 82, so as to avoid a subsequent return translation movement towards the locking position.

In particular, slot 82 also comprises a wide segment 82*b*, which ends in narrow segment 82*a* and in which distal end 79 of lever or appendage 76 can normally slide. In this way, when distal end 79 is coupled in a sliding manner in the aforesaid narrow segment 82*a*, slider 24 is freely mobile between its locking position and its release position, pretending that a user decides to act by moving lever or appendage 76, thus coupling distal end 79 (or another portion of lever or appendage 76 cooperating with profile 80) to narrow segment 82*a*.

In the embodiment show, shaped profile 80, and in particular slot 82, is obtained in washing machine W, for example in a part that is operatively stationary and associated with casing C. In particular, shaped profile 80 is obtained in wall or partition P1 delimiting the upper edge of access opening O.

The operating mode of apparatus 10 according to the embodiment shown of the present invention will be described below.

First of all, one should consider the configuration of dishwasher W with door D partially open (FIG. 1).

In this configuration, engagement element 11 has striker 14 kept in the retracted position by return means 15, stop mechanism 18 arranged in the locking position, pushing member 19 held in the extracted condition by stressing means 21, actuator 20 electrically unexcited, and detector means 23 detecting the retracted position of striker 14. More in detail, slider 24 is held in the locking position by elastic member 26, whereas cursor 36 is held in the inactive position by elastic element 38. Furthermore, conductor wire 22 is in the extended condition and is subject to a pull force. Furthermore, projection 14*h* leans against slider 24.

Now, safety element 18*a* is moved to the inhibition arrangement, thus moving stop mechanism 18 to the release condition and, hence, in this embodiment, slider 24 to its release position. In this way, if door D were accidentally pushed backwards, thus coupling retaining element 16 to engagement element 11, door D could not anyway be moved to the complete closing position, because stop mechanism 18 would not be able to hold, in particular by means of the action of slider 24, striker 14 in the retracted position. Therefore, as discussed above, manufacturers can improve the safety against an improper use of washing machine W, in particular by a baby.

Now, safety element 18*a* can be moved again to the liberation arrangement by an operator, who decides to perform a washing cycle.

In this situation, door D, with engagement element 11 uncoupled from retaining element 16, can be completely opened by a user and, therefore, the dishes to be washed can be introduced into washing chamber WT. Subsequently, the user can choose the washing cycle to be performed by dishwasher W by acting upon proper control interfaces that are typically available on door D.

Afterwards, the user closes door D towards casing C. During this operation, retaining element 16 and striker 14 of engagement element 11 are moved closer to one another so as to be coupled and, at the same time, door D pushes pushing member 19 from the extracted condition to the retracted condition and, in doing so, is guided by striker 14, in particular by lateral extension 14*b*.

After the above-mentioned closing operation has been performed by the user, dishwasher W has door D completely closed and engagement element 11 is arranged in the configuration shown in FIG. 2 and is coupled to retaining element 16. It has to be noted how pushing member 19—which is in contact with door D—exerts its action against door D, but is not able to cause it to open, since striker 14 acts as a "lock bolt", which holds door D in the closing position. As a matter of fact, even though striker 14 is able to move from the retracted position to the extracted position, it remains locked and steadily held in the retracted position due to the action of stop mechanism 18, in particular due to the fact that slider 24 leans against striker 14 (for example, against transverse projection 14*h*).

Therefore, in this door complete closing configuration, engagement element 11 has striker 14 in the retracted position, stop mechanism 18 in the locking condition, pushing member 19 in the retracted position, actuator means 20 electrically unexcited, and detector means 23 detecting the retracted position of striker 14. Hence, more in detail, slider 24 is held in the locking position by elastic member 26, whereas cursor 36 is held in the inactive position by elastic element 38. Furthermore, conductor wire 22 is in the extended and stretched condition.

Therefore, the washing cycle chosen by the user can be automatically started by the outer control unit of dishwasher W.

At the end of the above-mentioned washing cycle performed by washing machine W, the outer control unit provides actuator 20 with a current impulse, so as to electrically excite actuator 20 itself and, therefore, move stop mechanism 18 to the release condition.

The passage of electric current causes conductor wire 22 to heat up and to rapidly shift from the extended condition to the contracted condition, thus becoming shorter and dragging cursor 36 backwards from the inactive position to the active position against the action of elastic element 38. Therefore, after a short loadless travel (for example, approximately a half millimeter long), cursor 36 drags slider 24 from the locking position to the release position. More in detail, mushroom-shaped end 40 comes into contact with the converging ends of lateral arms 44 and, in this way, causes slider 24 to be dragged backwards.

In the embodiment shown, conductor wire 22 is designed to reduce its length by approximately 3.5% during the passage from the extended and stretched condition to the contracted and shortened condition.

In this way, striker 14 is free to move to the extracted position due to the connection with retaining element 16, which is carried by door D, with the help of pushing member 19. Indeed, pushing member 19 helps push door D away from casing C against the retaining action of return means 15, which act upon striker 14, thus keeping it in the retracted position. When striker 14 and pushing member 19 are in the extracted position or condition, the respective proximal sliders 14*a* and 19*a* lean against the walls of support body 12, for example on the periphery of the lower half-shell 12*a*, thus preventing them from being subject to a possible undesired overtravel.

Advantageously, during this step, abutment 14*g* of striker 14 leans against abutment 19*g* of pushing member 19, so that striker 14 and pushing member 19 are integral in the movement towards the respective extracted condition or position.

Preferably, striker 14 and pushing member 19 are designed, when they are arranged in the extracted position, to further project from support body 12 with a length measuring centimeters (preferably ranging from 1 cm to 3 cm, but, in some use conditions, even measuring more than 5 cm relative to the normal projection that striker 14 and pushing member 19 assume when they are arranged in the retracted position or condition); in this way, the distance between door D and access opening O corresponds to the length mentioned above, which is sufficient to permit a fluid communication between washing chamber WT and the outside of casing C. In the embodiment shown, the aforesaid length is equal to approximately 5.5 cm.

Furthermore, when striker 14 moves past mobile element 23*a*, detector means 23 detect the movement of striker 14 to the extracted position, which, in this case, indicates that the pre-opening position of door D has been reached.

At the end of the electric current impulse provided by outer control unit, actuator 20 goes back to the electrically unexcited condition and stop mechanism 18 goes back to the locking condition.

During this step, when the electric current impulse has ended, conductor wire 22 starts cooling down and gradually goes back to the extended condition, thus becoming longer, and elastic element 38 accordingly and progressively pushes cursor 36 forward towards the inactive position following the loop of conductor wire 22, which is extending; in particular, mushroom-shaped end 40 of elastic element 38 gradually moves forward towards the inactive position following the stretching out of conductor wire 22. Consequently, lateral arms 44 of slider 24, which had been previously dragged backwards by cursor 36, tend to follow the forward movement of mushroom-shaped head 40 due to elastic member 26 and cause slider 24 to gradually move back to the locking position.

In the embodiment shown, elastic element 38 has an elastic compression preload of approximately 0.5 kg and conductor wire 22 has a diameter of approximately 0.38 mm. The preload of elastic element 38 is adjusted as a function of the diameter of conductor wire 22, so that cursor 36 can actually be brought back to the inactive position.

In the embodiment shown, elastic member 26 has an elastic compression preload of approximately 200 g, which is smaller than the one of the elastic element. As a matter of fact, elastic member 26 fulfills the main function of preventing slider 24 from correctly repositioning itself in the locking position, in particular in case the returning action of elastic element 38, which is suited to cause the return of conductor wire 22, is affected by accidental jamming or seizing.

In the embodiment shown, conductor wire 22 is designed to cool down and go back from the contracted and shortened condition to the extended and stretched condition over a time of approximately 13 s.

Optionally, when stop mechanism 18 reaches the release condition, it interrupts the electric connection between the outer control unit and actuator 20. This measure is adopted in order to prevent conductor wire 22 from being damaged due to an excessive overheating caused by a possible accidentally and anomalously prolonged duration of the excitation current impulse provided by the outer control unit (provoked, for example, by a failed interruption of the nominal operating times). This measure can be implemented in different ways.

A first way involves safety switch 45. More in detail, when cursor 36 reaches the active position, it interferes with safety switch 45, thus opening it and interrupting the passage of current through conductor wire 22. In particular, projection 52 of cursor 36 leans against the shaped projection of the mobile contact of safety switch 45, thus moving it away from the stationary contact associated therewith.

A second way involves the use of sensor means 23. More in detail, when mobile element 23*a* is brought by striker 14 (in particular, cooperating with its transverse projection 14*h*) from the normally inactive condition to the active condition, sensitive element 23*b* detects its movement and is suited to signal it to the outer control unit of the dishwasher, for example through contacts 72. In this way, the outer control unit receives the signal coming from sensitive element 23*b* and interrupts the current flowing through actuator means 20, in particular conductor wire 22. In the embodiment shown, when mobile element 23*a* moves to the active condition, the appendage of the latter interacts with the mobile contact of switch 23*b*, so that switch 23*b* generates the above-mentioned signal, which is intended to be received by the outer control unit.

If necessary, the two switches 23*b* and 45 can cooperate with one another, thus providing the outer control unit with the signal, only if they are both properly activated by mobile element 23*a*, in particular with its terminal appendage, and, respectively, by stop mechanism 18, in particular by cursor 36 (for example, with its projection 52). In both the embodiments shown, switches 23*b* and 45 are designed to signal the movement of striker 14 from the retracted condition to the extracted condition (in this case indicating the movement of door D to the pre-opening condition), when they are both open.

When stop mechanism 18 goes back to the locking position and striker 14 has moved to the extracted condition, door D is in the pre-opening condition, in which it is sufficiently spaced apart from access opening O to allow a fluid communication between washing chamber WT and the outside to be established. The distance between door D and access opening O allows the steam generated during a washing cycle of dishwasher W to flow out and, therefore, allows the dishes contained in washing chamber WT to be dried.

With reference, in particular, to FIG. 7, at the end of the overall operating cycle of the dishwasher, the user can uncouple door D from casing C by acting upon mechanisms arranged on door D and by moving retaining element 16 to the rest position. This is how retaining element 16 is uncoupled from striker 14 of engagement element 11.

In this way, return means 15 are not subject any longer the opposition to the return of striker 14 to the retracted position, since striker 14 is not constrained to door D. The return force exerted by return spring 15 causes profile 30 carried by striker 14 (in particular, by transverse projection 14*h*) to rest against profile 28 carried by slider 24, so as to generate a transverse thrust relative to striker 14. As already mentioned above, return spring 15 is dimensioned so as to generate a transverse thrust that is able to move slider 24 backwards, thus overcoming the opposition force developed by elastic member 26. When profile 30 of striker 14 moves past profile 28 of slider 24, striker 14 cannot exert the aforesaid transverse thrust any longer and, therefore, elastic member 26 brings slider 24 back to the locking position, in particular by positioning itself under striker 14.

During the cooperation between profiles 28 and 30, the backward movement of slider 24 does not interfere with the position of cursor 36 and elastic element 38, as a consequence, is not stressed, in particular thanks to the sliding coupling with clearance between the two of them. More in detail, the proximal portion of cavity 42 moves relative to the head of mushroom-shaped end 40, without them hitting against one another.

Therefore, in both the embodiments shown, the cooperation between slider 24 and cursor 36 leads to an advantage that consists in preventing conductor wire 22, during the movement of striker 14 from the extracted position to the retracted position, from temporarily releasing stop mechanism 18, thus causing a failure or a damage of apparatus 10. Indeed, when striker 14 is moved from the extracted position to the retracted position by return means 15, slider 24 can freely move from the locking position to the release position against the action of elastic member 26 without interfering with cursor 36, in particular thanks to the sliding clearance that is advantageously created between mushroom-shaped head 40 and lateral arms 44. In this way, cursor 36 is not moved backwards and does not release the pull of conductor wire 22, which, instead, always remains subject to a pull force.

Simultaneously, pushing member 19 is kept in the extracted condition by elastic stressing means 21, which are not subject to any opposition by stop mechanism 18 or by striker 14. Therefore, in this embodiment, stop mechanism 18 is neither directly cooperating with nor directly constrained to pushing member 19, but through striker 14.

Hence, door D can be further opened relative to the pre-opening configuration and the dishes that have been washed—and at least partially dried—can be removed by the user, so that operations can be started again to perform a further washing cycle, thus repeating the operation steps described above.

Please, note that, once the user has finished using the machine, door D can be finally closed by the user, by leaning against pushing member 19, by pushing it backwards in the retracted condition and by coupling striker 14 to retaining element 16. In the embodiment shown, the movement from the extracted condition to the retracted condition of pushing member 19 is controlled by the backward thrust exerted by means of door D, which is pushed by the user so as to get closed. The fact that pushing member 19 is kept in the retracted condition is ensured by the coupling of striker 14 to retaining element 16. Indeed, this coupling holds door D in contact with pushing member 19 by means of stop mechanism 18, which prevents striker 14 from moving relative to the support body. This situation corresponds to the operating configuration shown in FIG. 5.

Naturally, the principle of the present invention being set forth, the embodiments and the implementation details can be widely changed relative to what described above and shown in the drawings as a mere way of non-limiting example, without in this way going beyond the scope of protection provided by the accompanying claims.

For example, the places in which engagement element 11 and retaining element 16 are fitted can be switched compared to what described above and shown in the drawings (in particular, engagement element 11 can be mounted on door D, whereas retaining element 16 can be mounted on casing C).

The invention claimed is:

1. Apparatus for controlling closing of a door of a household appliance, in particular for a washing machine; said door being arranged to close an inner chamber obtained in a casing of said household appliance and communicating outside through an inlet opening; said apparatus comprising an engagement element, which is configured to be fitted on one of said casing and said door and arranged for being held in a releasable manner by a retaining element configured to be fitted on the other one of said door and said casing to constrain said door to said casing, when using said household appliance;

wherein said engagement element comprises:

a support body configured to be fitted on one of said casing and said door;

a striker adapted to be coupled in a releasable manner to said retaining element, and mounted so as to move relative to said support body between a retracted position and an extracted position; when said striker is coupled to said retaining element and assumes said retracted position and said extracted position, said door being suited to be, respectively:

in a complete closing condition, in which said door closes said access opening in a fluid-tight manner, and in a pre-opening condition, in which said door is spaced apart from said access opening, so as to establish a fluid communication between said inner chamber and an environment outside said casing;

a stop mechanism tending to move:

from a release position, in which said stop mechanism is adapted to liberate said striker, thus allowing said striker to move from said retracted position to said extracted position, when said striker is coupled to said retaining element, to a locking position, in which it is adapted to hold said striker, when said striker is in said retracted position;

wherein said stop mechanism comprises:

a slider, which is mounted so as to move relative to said support body from a locking position, in which said slider is arranged to hold said striker in said retracted position, to a release position, in which said slider allows said striker to move from said retracted position to said extracted position due to an electrical excitation of said driving means; and an elastic member tending to hold said slider in said locking position;

a safety element, which is manually controllable by a user and is movable between:

a liberation arrangement, in which the safety element allows the stop mechanism to move between the locking condition and the release condition, and an inhibition condition, in which the safety element forcedly constrains the stop mechanism in the release condition; wherein said stop mechanism constrains said striker, thus preventing said striker from moving towards said extracted position, when said striker is in said retracted position and said stop mechanism is in the locking condition;

wherein said safety element is a lever or appendage capable of projecting from said slider in a position in which the safety element is accessible to a user and is configured to be grabbed by the user, wherein said lever or appendage has a portion capable of cooperating with a shaped profile; said shaped profile being delimited by a slot in said support body and in which said portion is configured for being engaged and locked in the inhibition arrangement wherein in said inhibition condition, said portion is constrained by said shaped profile, preventing said slider from moving to said locking position; said safety element being carried by said slider and preventing said slider from moving to said locking position when said safety element is in the inhibition condition;

electrically operated driving means, wherein when the safety element is in the liberation arrangement, the driving means control movement of said stop mechanism from said locking position to said release position.

2. The apparatus according to claim 1, wherein said stop mechanism acts in a transverse direction relative to the moving direction of said striker.

3. The apparatus according to claim 1, wherein said slider and said striker have respective complementary profiles which cooperate one with the another and which are configured for allowing, by interference, forced movement of said striker from the extracted position to the retracted position against the action of said elastic member.

4. The apparatus according to claim 1, wherein said stop mechanism comprises:

a cursor, which is movable by said driving means and is mounted so as to move relative to said support body from an inactive position, in which said cursor allows said slider to move from said release position to said locking position due to action of said elastic member, to an active position, in which said cursor drags said slider from said locking position to said release position against the action of said elastic member, when said driving means are electrically excited; and an elastic element, which holds said cursor in said inactive position.

5. The apparatus according to claim 4, wherein said slider and said cursor are coupled with a sliding clearance.

6. The apparatus according to claim 4, wherein said elastic element exerts a return elastic force on said cursor, which is greater than the return elastic force exerted by said elastic member on said slider.

7. The apparatus according to claim 4, wherein said slider and/or said cursor is able to be moved in a direction that is orthogonal to a moving direction of said striker.

8. The apparatus according to claim 1, wherein said driving means control the movement of said stop mechanisms from said locking condition to said release condition, when said driving means are excited by a passage of electric current, thus moving from a normally extended condition to contracted position, in which said driving means respectively allow said stop mechanism to assume said locking condition and bring said stop mechanism to said release condition.

* * * * *